United States Patent [19]

Hwan

[11] Patent Number: 4,813,574

[45] Date of Patent: Mar. 21, 1989

[54] WALL-CREVICE STUFFING MATERIAL DISPENSER

[76] Inventor: Chi-Chuan Hwan, No. 12, Tong Shih Lane, Ting Nien T'sun, Fu Hsing Hsiang, Changhua Hsien, Taiwan

[21] Appl. No.: 90,155

[22] Filed: Aug. 24, 1987

[51] Int. Cl.[4] ..... B65D 88/54

[52] U.S. Cl. ..... 222/325; 222/391

[58] Field of Search ..... 222/391, 326, 325, 327, 222/386

[56] References Cited

U.S. PATENT DOCUMENTS 2,634,889 4/1953 Sherbondy ..... 222/391

4,509,662 4/1985 Weiss ..... 222/391

*Primary Examiner*—Kevin P. Shaver

*Assistant Examiner*—Kenneth Noland

*Attorney, Agent, or Firm*—Browdy & Neimark

[57] ABSTRACT

A gun-shaped stuffing material dispenser which is particularly employed to apply stuff substance to crevices on walls or the places, such as the clefts along the four sides of a window frame at its mount. The present disclosure characteristically consists of an integrally formed gun body, to the front end of which is removably pivotably secured a ring support member, and a piston rod which is provided with a push plate pivotably attached to the front end thereof so to effect ready packing, transportation and fast production purpose.

3 Claims, 1 Drawing Sheet

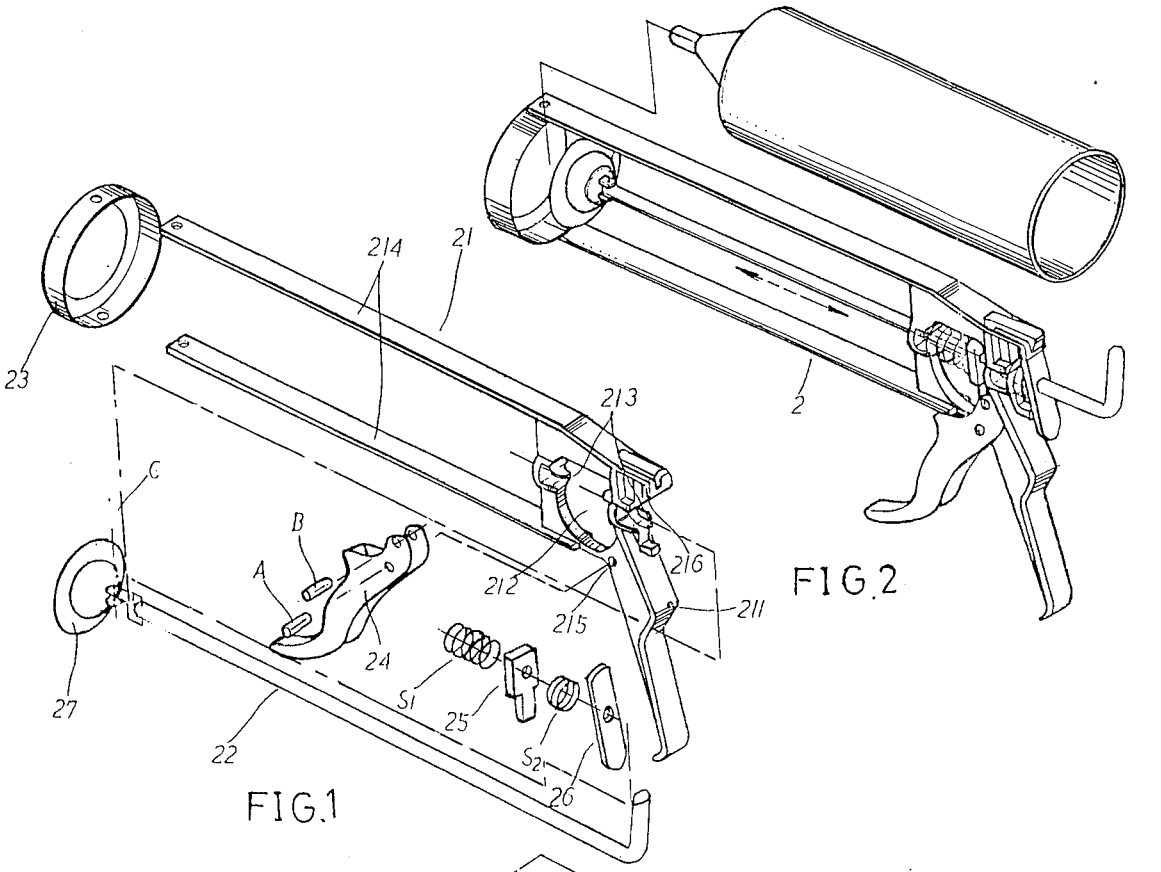
FIG.1
FIG.2
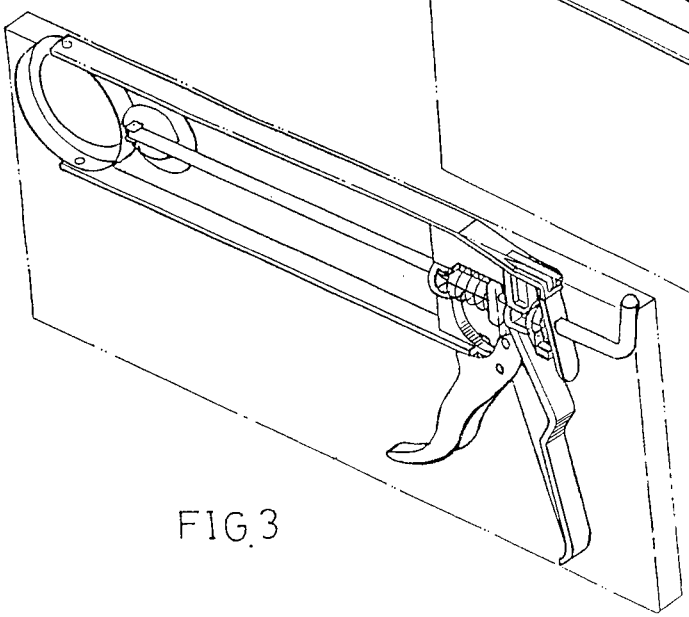
FIG.3
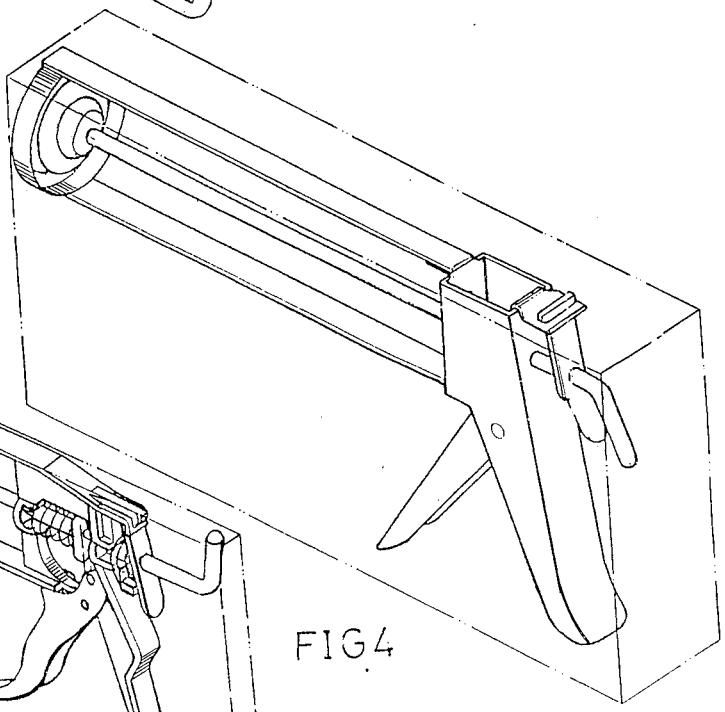
FIG.4

WALL-CREVICE STUFFING MATERIAL DISPENSER

BACKGROUND OF THE INVENTION

The present invention relates to an improved wall crevice stuffing material dispenser which includes a cylinder case, a gun body, integrally formed of special nylon material and provided with a pivotable ring support member at the front end thereof, and a piston rod is disposed axially therein with a push plate pivotably mounted on the front end thereof so that said circular support member and push plate can both be pivoted in either way in packing for reducing the size thereof, and the manufacturing cost can be lowered and production process also be simplified effectively; furthermore the working pressure in the present device is able to be raised effectively for increasing the performce thereof.

The primary object of the present invention is to provide an improved stuffing material dispenser which is particularly used to apply stuffing substance to the crevices on walls or along the four sides of a window frame in its mounting place, and is characterized in its ring support member pivotably disposed at the front end of said gun body and the pivotable push plate planted at the front end of said piston rod, thus facilitating the packing and, above all, reduce the size therein so to lower transportation cost.

One further object of the present invention is to provide an improved stuffing material dispenser which is characterized in that the gun body, ring support member, push plate and trigger arm are made of special nylon material which is light in weight, and firm in strength and rust-proof so that it can be operated readily and efficiently and the life of utilization is also prolonged thereby.

BRIEF DESCRIPTION OF THE DRAWINGS

To make the structure and operation mode and features of the present invention more comprehensive, a number of drawings are provided along with a detailed description of the present invention, in which:

FIG. 1 is the perspective exploded view of the present invention,

FIG. 2 is the assembly of the present invention,

FIG. 3 is a diagram showing the present invention can be packed in a more compact form, and FIG. 4 is a diagram showing the conventionally structured device being packed in a larger box.

DETAILED DESCRIPTION

Referring to FIGS. 1, and 2, the present stuffing material dispenser comprises in combination a gun body 2 and a cylinder case, wherein said gun body 2 consists of an integrally formed structure 21 having a handle 211 disposed at the rear end thereof, and an accommodating space 212, a pair of symmetric holes 213 planted on the front and rear walls of said space 212 for permitting the disposition of an axially located L-shaped elongate piston rod 22 in assembly.

A pair of axially extended elongate oblong plates 214 are disposed on the top and bottom of said structure 21 with a ring support member 23 pivotably secured at the front end thereof, which can be rotated in either way in packing for reducing the size thereof.

A through hole 215 is planted on the top end of said handle 211 for removably securing thereto a pivotably operated trigger arm 24 by means of a pin A. Furthermore, an actuating block 25 along with a spring S1 disposed therebefore is mounted on said piston rod 22 and housed within said accommodating space 212, with said actuating block 25 in engagement with said trigger arm 24 by way of the bottom end of the former in engagement with a pin B mounted on said trigger arm 24.

A stop member 26 in combination with a spring S2 is mounted on the rear portion of said L-shaped piston rod with both located under the rear end of said upper extended elongate support plate 214 with said piston rod 22 going therethrough, and said piston rod 22 is provided with a pivotably rotated push plate 27 fixed by means of a pin C at the frontmost end of said piston rod 22.

When operating on said trigger arm 24, said pin B is pivoted forward so to push said actuating block 25 move along, forcing said spring S1 into compression, and said piston rod 22 is simultaneously brought forward by frictional force accordingly. When said trigger arm 24 is released from the operating finger, the compressed spring S1 will force said actuating block 25 move backward, relative to said piston rod 22, so the released trigger arm 24 is brought back to the inoperative position; in the meanwhile, said piston rod 22 is held in its forward-moved position without retracting, as a result of the restraint by said spring S2 as well as said stop member 26; thus by consecutively operating said trigger arm 24, said piston rod 22 will be continually progressed forward in a step manner. To bring said piston rod 22 back to the inoperative position, said stop member 26 must be pressed forward and the rear end of said piston rod 22 is pulled backward, so the device can be repeatedly operated.

The advantages of the present invention are presented as below:

1. The gun body portion is integrally formed in the production process so that the time, needed to make the product, can be reduced and the labor required is accordingly cut down.

2. Said gun body portion, trigger arm, ring support member, and push plate are made of special light nylon material by way of extrusion molding, so the weight of the present device is greatly reduced and the anti-rust process on the same device is not needed.

3. Said ring support member as well as said push plate is able to be pivoted in either way from a transverse position to an axial position for reducing the size of the present device in packing operation so to effectively lower the transportation cost.

To further illustrate the advantages of the present dispenser over the prior art, a number of comparisons are listed as follows:

| prior art | present invention |
|---|---|
| 1. working pressure: 220 lbs | 250 lbs |
| 2. material: steel or aluminum | special nylon |
| 3. coating: painting | no anti-rust treatment |
| 4. net weight: 0.52 kg | 0.320 kg |
| 5. transportation fee: 1 | ¼ |
| 6. transportation volume: 0.121 ft | 0.03 ft |
| 7. unit cost: 1.75 | 1.0 |
| 8. production hour: 2 | 1 |
| 9. automation in production: 10% | 70% |
| 10. manpower needed for manufacturing: 3 | 1 |

What is claimed is:

1. An improved stuffing material dispenser for use in applying stuffing substance to crevices on walls or places of the like, mainly comprising a gun body portion and a cylinder case, a handle provided at the right end of said gun body portion with an accommodating space located at the top end thereof, a pair of axially aligned through holes being placed on the front and rear wall of said accommodating space for passing through of an elongate piston rod; a pair of parallel axially extended oblong upper and lower support plates being disposed on said gun body portion with a ring support member pivotably fixed on the front end thereof; a trigger arm being pivotably mounted to said handle by means of a pin with the top portion of said trigger arm partially located in said accommodating space; a first spring and an actuating block being housed in and restrained by the front and rear wall thereof with said piston rod going through the center thereof; a push plate being pivotably secured to the frontmost end of said piston and being fitly located within said cylinder case in an operational manner; by operating said trigger arm, said piston rod being able to be pushed forward by means of said actuating block step by step, and said trigger arm being able to bring back to its inoperative position by said first spring which also forces said actuating block back to its normal position after said trigger arm is released; said stepwise forward moved piston rod, due to the continual operation of said trigger arm, being held in place without retreating from its forward moving position by means of a stop member in cooperation with a second spring, and being able to be brought back to its starting position only by forward pressing said stop member and pulling the rear end of said piston rod so that said dispenser can be repeatedly operated.

2. An improved stuffing material dispenser as set forth in claim 1, wherein said ring support member is pivotably connected to the front end of said parallelly disposed upper and lower oblong support plates of said gun body portion.

3. An improved stuffing material dispenser as set forth in claim 1, wherein said push plate is pivotably fixed to the front end of said piston rod.

* * * * *